US010260500B2

(12) United States Patent
Qi et al.

(10) Patent No.: US 10,260,500 B2
(45) Date of Patent: Apr. 16, 2019

(54) DOWNHOLE DYNAMOMETER AND METHOD OF OPERATION

(71) Applicant: General Electric Company, Schenectady, NY (US)

(72) Inventors: Xuele Qi, Edmond, OK (US); Cheng-Po Chen, Niskayuna, NY (US); Grant Lynn Hartman, Oklahoma City, OK (US); Yizhen Lin, Cohoes, NY (US); David Mulford Shaddock, Troy, NY (US)

(73) Assignee: General Electric Company, Schenectady, NY (US)

( * ) Notice: Subject to any disclaimer, the term of this patent is extended or adjusted under 35 U.S.C. 154(b) by 25 days.

(21) Appl. No.: 15/595,685

(22) Filed: May 15, 2017

(65) Prior Publication Data

US 2018/0328357 A1 Nov. 15, 2018

(51) Int. Cl.
*F04B 51/00* (2006.01)
*E21B 43/12* (2006.01)
(Continued)

(52) U.S. Cl.
CPC ..... *F04B 51/00* (2013.01); *E21B 43/126* (2013.01); *E21B 47/022* (2013.01); *E21B 47/06* (2013.01);
(Continued)

(58) Field of Classification Search
USPC ..... 73/152.01, 152.59
See application file for complete search history.

(56) References Cited

U.S. PATENT DOCUMENTS 1,739,724 A 12/1929 Lake
1,877,467 A 9/1932 Lake
(Continued)

FOREIGN PATENT DOCUMENTS

CA 2309523 A1 12/2000
CA 2767538 A1 6/2013
(Continued)

OTHER PUBLICATIONS

Schnitman et al., "Modeling and Implementation of a System for Sucker Rod Downhole Dynamometer Card Pattern Recognition", SPE Annual Technical Conference and Exhibition, Oct. 5-8, Denver, Colorado, pp. 4, Document ID:SPE-84140-MS, 2003, Colorado.

(Continued)

*Primary Examiner* — Clayton E. LaBalle
*Assistant Examiner* — Warren K Fenwick
(74) *Attorney, Agent, or Firm* — Armstrong Teasdale LLP

(57) ABSTRACT

A downhole dynamometer for a rod pumping unit is provided. The downhole dynamometer includes a shell within which a plurality of sensors, a non-transitory memory, and a dynamometer controller are located. The shell is configured to be coupled to a sucker rod string of the rod pumping unit and disposed in a well opposite a wellhead of the well. The plurality of sensors is configured to measure downhole accelerations of the sucker rod string and to measure a downhole load on the sucker rod string. The dynamometer controller is coupled to the plurality of sensors and the non-transitory memory. The dynamometer controller is configured to periodically collect measurements from the plurality of sensors and store the measurements in the non-transitory memory.

20 Claims, 7 Drawing Sheets

(51) Int. Cl.
*E21B 47/06* (2012.01)
*E21B 47/022* (2012.01)
*F04B 47/02* (2006.01)

(52) U.S. Cl.
CPC ..... *F04B 47/02* (2013.01); *F04B 2201/121* (2013.01); *F04B 2207/02* (2013.01); *F04B 2207/03* (2013.01)

(56) References Cited

U.S. PATENT DOCUMENTS

| | | | | |
|---|---|---|---|---|
| 1,889,730 | A | 11/1932 | Lake | |
| 2,097,150 | A | 10/1937 | Gilbert et al. | |
| 2,659,233 | A | 11/1953 | Fagg et al. | |
| 3,023,615 | A | 3/1962 | Bennett | |
| 3,251,310 | A | 5/1966 | Wittwer et al. | |
| 3,343,409 | A | 9/1967 | Gibbs | |
| 3,457,781 | A | 7/1969 | Elliott | |
| 3,499,324 | A | 3/1970 | Wenisch | |
| 3,951,209 | A | 4/1976 | Gibbs | |
| 4,043,191 | A | 8/1977 | Mills | |
| 4,143,546 | A | 3/1979 | Wiener | |
| 4,208,665 | A | 6/1980 | Mills | |
| 4,307,395 | A | 12/1981 | Standish | |
| 4,363,605 | A | 12/1982 | Mills | |
| 4,483,188 | A | 11/1984 | McTamaney et al. | |
| 4,509,901 | A | 4/1985 | McTamaney et al. | |
| 4,551,730 | A | 11/1985 | McTamaney et al. | |
| 4,594,665 | A | 6/1986 | Chandra et al. | |
| 4,622,635 | A | 11/1986 | Chandra et al. | |
| 4,631,954 | A | 12/1986 | Mills | |
| 4,706,388 | A * | 11/1987 | Van Steenwyk ..... | E21B 47/022 33/304 |
| 4,947,936 | A | 8/1990 | Ellwood | |
| 5,224,834 | A | 7/1993 | Westerman et al. | |
| 5,252,031 | A | 10/1993 | Gibbs | |
| 5,314,016 | A | 5/1994 | Dunham | |
| 5,464,058 | A * | 11/1995 | McCoy ..... | E21B 47/0008 166/250.01 |
| 5,606,124 | A * | 2/1997 | Doyle ..... | E21B 47/022 33/304 |
| 6,176,682 | B1 | 1/2001 | Mills | |
| 6,343,656 | B1 | 2/2002 | Vazquez et al. | |
| 6,409,476 | B2 | 6/2002 | Mills | |
| 6,857,474 | B2 | 2/2005 | Bramlett et al. | |
| 7,168,924 | B2 | 1/2007 | Beck et al. | |
| 7,212,923 | B2 | 5/2007 | Gibbs et al. | |
| 7,891,237 | B2 | 2/2011 | Mills | |
| 8,336,613 | B2 | 12/2012 | Ramsey et al. | |
| 8,433,516 | B1 | 4/2013 | Gibbs et al. | |
| 8,444,393 | B2 | 5/2013 | Beck et al. | |
| 8,793,080 | B1 | 7/2014 | Erlandsson et al. | |
| 8,849,594 | B2 | 9/2014 | Mills | |
| 9,091,604 | B2 * | 7/2015 | Kobata ..... | E21B 44/00 |
| 2005/0155759 | A1 * | 7/2005 | Bramlett ..... | E21B 47/0008 166/250.15 |
| 2008/0118382 | A1 | 5/2008 | Ramsey et al. | |
| 2009/0055029 | A1 | 2/2009 | Roberson et al. | |
| 2010/0326668 | A1 | 12/2010 | Griffiths et al. | |
| 2013/0104645 | A1 * | 5/2013 | Pons ..... | F04B 49/065 73/152.61 |
| 2013/0115107 | A1 | 5/2013 | Pons | |
| 2015/0142319 | A1 * | 5/2015 | McCoy ..... | E21B 47/0007 702/9 |
| 2016/0076362 | A1 | 3/2016 | Shanks | |
| 2016/0102542 | A1 | 4/2016 | Dacunha et al. | |
| 2017/0002635 | A1 | 1/2017 | Williams et al. | |
| 2017/0016313 | A1 * | 1/2017 | Pons ..... | G05B 19/042 |
| 2017/0037714 | A1 * | 2/2017 | Schmitt ..... | E21B 43/129 |
| 2017/0167482 | A1 * | 6/2017 | Assad ..... | E21B 47/0008 |
| 2018/0128264 | A1 * | 5/2018 | Robison ..... | E21B 43/127 |

FOREIGN PATENT DOCUMENTS

| | | | |
|---|---|---|---|
| CA | 2790352 | A1 | 10/2013 |
| CN | 2248779 | Y | 3/1997 |
| CN | 2549435 | Y | 5/2003 |
| CN | 2937474 | Y | 8/2007 |
| CN | 200946502 | Y | 9/2007 |
| CN | 200965726 | Y | 10/2007 |
| CN | 200986477 | Y | 12/2007 |
| CN | 101135910 | A | 3/2008 |
| CN | 101498296 | A | 8/2009 |
| CN | 102072788 | A | 5/2011 |
| CN | 202281670 | U | 6/2012 |
| CN | 202471324 | U | 10/2012 |
| CN | 202533060 | U | 11/2012 |
| CN | 202956665 | U | 5/2013 |
| WO | 9302289 | A1 | 2/1993 |
| WO | 2013085637 | A1 | 6/2013 |
| WO | 2014040264 | A1 | 3/2014 |

OTHER PUBLICATIONS

Albert, G. D., et al. "Downhole Measurement on Pumping Oil Wells", SPE Production Technology Symposium, Society of Petroleum Engineers, pp. 1-8 (Nov. 17, 1987).

International Search Report and Written Opinion issued in connection with corresponding PCT Application No. PCT/US2018/026688 dated Jul. 26, 2018.

* cited by examiner

DOWNHOLE DYNAMOMETER AND METHOD OF OPERATION

BACKGROUND

The field of the disclosure relates generally to rod pumping units and, more particularly, to a downhole dynamometer and method of operation for computing a downhole dynamometer card for a rod pumping unit.

Most known rod pumping units (also known as surface pumping units) are used in wells to induce fluid flow, for example oil and water. Examples of rod pumping units include, for example, and without limitation, linear pumping units and beam pumping units. Rod pumping units convert rotating motion from a prime mover, e.g., an engine or an electric motor, into reciprocating motion above the wellhead. This motion is in turn used to drive a reciprocating downhole pump located in a production region of the well via connection through a sucker rod string. Generally, the production region of a well is referred to as downhole, at an end of the sucker rod string opposite the wellhead. The sucker rod string, which can extend miles in length down the wellbore to the production region of the well, transmits the reciprocating motion from the wellhead at the surface to a subterranean piston, or plunger, and valves in a fluid bearing zone of the well. The reciprocating motion of the piston valves induces the fluid to flow up the length of the sucker rod string to the wellhead.

The rod pumping units are exposed to a wide range of conditions. These vary by well application, the type and proportions of the pumping unit's linkage mechanism, and the conditions of the well. Furthermore, well conditions, such as downhole pressure, may change over time. These conditions may cause variability in the flow of the fluid.

The rod pumping unit imparts continually varying motion on the sucker rod string. The sucker rod string responds to the varying load conditions from the surface unit, down-hole pump, and surrounding environment by altering its own motion statically and dynamically. The sucker rod string stretches and retracts as it builds the force necessary to move the down-hole pump and fluid. The rod pumping unit, breaking away from the effects of friction and overcoming fluidic resistance and inertia, tends to generate counter-reactive interaction force to the sucker rod string exciting the dynamic modes of the sucker rod string, which causes an oscillatory response. Traveling stress waves from multiple sources interfere with each other along the sucker rod string (some constructively, others destructively) as they traverse its length and reflect load variations back to the rod pumping unit, where they can be measured. Measurements of the position and load of the rod pumping unit at the surface are referred to as a surface dynamometer card, or a surface card.

Generally, the surface measurements are used in diagnostic analysis to determine downhole position and load. The relationship between surface measurements and downhole measurements is represented, for example, and without limitation, by a model of the sucker rod string referred to as the wave equation, which models the propagation of waves in a continuous medium as a one-dimensional partial differential equation. Solutions to the wave equation generally yield a displacement of a point on the sucker rod string at a given time. Translating the surface measurements to downhole measurements by solving the wave equation is computationally intensive and can be inaccurate for highly-deviated wells. The downhole measurements are referred to as a downhole dynamometer card, or pump card.

Downhole dynamometer cards computed using various techniques produce varying results based on conditions at the rod pumping unit and downhole at the pump. Many known rod pumping unit controllers utilize a technique best suited for that particular rod pumping unit. Inaccuracies in the downhole dynamometer card may result in inefficient operation of the rod pumping unit and delayed diagnostic feedback.

BRIEF DESCRIPTION

In one aspect, a downhole dynamometer for a rod pumping unit is provided. The downhole dynamometer includes a shell within which a plurality of sensors, a non-transitory memory, and a dynamometer controller are located. The shell is configured to be coupled to a sucker rod string of the rod pumping unit and disposed in a well opposite a wellhead of the well. The plurality of sensors is configured to measure downhole accelerations of the sucker rod string and to measure a downhole load on the sucker rod string. The dynamometer controller is coupled to the plurality of sensors and the non-transitory memory. The dynamometer controller is configured to periodically collect measurements from the plurality of sensors and store the measurements in the non-transitory memory.

In another aspect, a rod pumping unit is provided. The rod pumping unit includes a sucker rod string, a downhole dynamometer, and a pump controller. The downhole dynamometer is configured to be coupled to the sucker rod string and disposed in a well opposite a wellhead of the well. The downhole dynamometer includes a plurality of sensors configured to measure downhole conditions of the well. The downhole dynamometer further includes a non-transitory memory and a dynamometer controller coupled to the plurality of sensors and the non-transitory memory. The dynamometer controller is configured to periodically collect measurements from the plurality of sensors and store the measurements in the non-transitory memory. The pump controller includes a processor configured to be coupled to the non-transitory memory. The processor is further configured to gain access to the measurements in the non-transitory memory and to compute a downhole dynamometer card based on the measurements.

In yet another aspect, a method of operating a downhole dynamometer is provided. The downhole dynamometer is disposed in a well opposite a wellhead of the well, and is coupled to a sucker rod string of a rod pumping unit. The method includes measuring downhole accelerations of the sucker rod string and measuring a downhole load of the sucker rod string. The method includes periodically collecting the downhole accelerations and the downhole load. The method includes storing the downhole accelerations and the downhole load on a non-transitory memory.

DRAWINGS

These and other features, aspects, and advantages of the present disclosure will become better understood when the following detailed description is read with reference to the accompanying drawings in which like characters represent like parts throughout the drawings, wherein.

Figure 1:
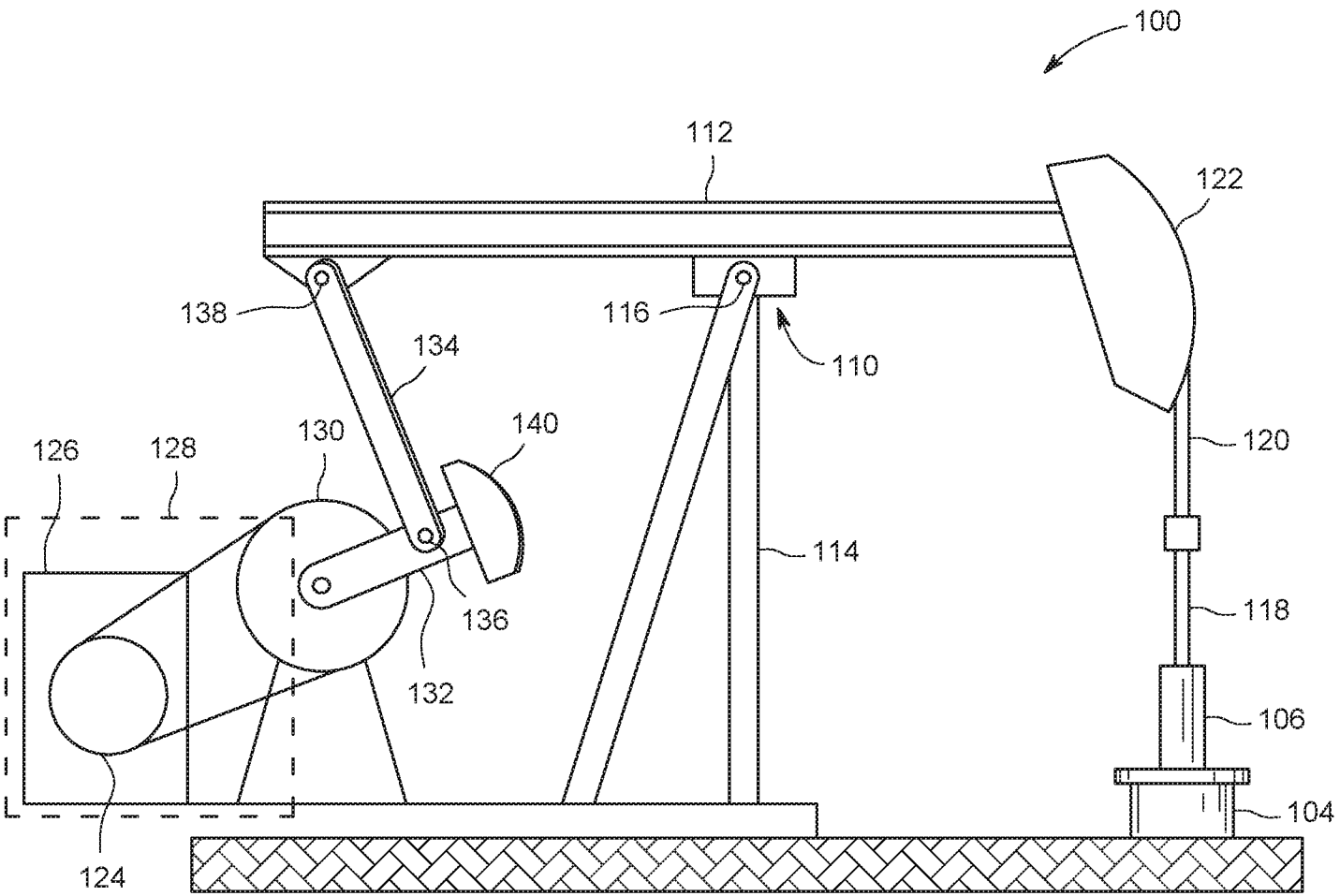
FIG. 1 is a diagram of an exemplary beam-type rod pumping unit.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, a number of terms are referenced that have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

Some embodiments involve the use of one or more electronic or computing devices. Such devices typically include a processor, processing device, or controller, such as a general purpose central processing unit (CPU), a graphics processing unit (GPU), a microcontroller, a reduced instruction set computer (RISC) processor, an application specific integrated circuit (ASIC), a programmable logic circuit (PLC), a field programmable gate array (FPGA), a digital signal processing (DSP) device, and/or any other circuit or processing device capable of executing the functions described herein. The methods described herein may be encoded as executable instructions embodied in a computer readable medium, including, without limitation, a storage device and/or a memory device. Such instructions, when executed by a processing device, cause the processing device to perform at least a portion of the methods described herein. The above examples are exemplary only, and thus are not intended to limit in any way the definition and/or meaning of the term processor and processing device.

As used herein, the terms "processor" and "computer" and related terms, e.g., "processing device", "computing device", and "controller" are not limited to just those integrated circuits referred to in the art as a computer, but broadly refers to a microcontroller, a microcomputer, a programmable logic controller (PLC), an application specific integrated circuit, and other programmable circuits, and these terms are used interchangeably herein. In the embodiments described herein, memory may include, but is not limited to, a computer-readable medium, such as a random access memory (RAM), and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

Further, as used herein, the terms "software" and "firmware" are interchangeable, and include any computer program stored in memory for execution by personal computers, workstations, clients and servers.

As used herein, the term "non-transitory computer-readable media" is intended to be representative of any tangible computer-based device implemented in any method or technology for short-term and long-term storage of information, such as, computer-readable instructions, data structures, program modules and sub-modules, or other data in any device. Therefore, the methods described herein may be encoded as executable instructions embodied in a tangible, non-transitory, computer readable medium, including, without limitation, a storage device and a memory device. Such instructions, when executed by a processor, cause the processor to perform at least a portion of the methods described herein. Moreover, as used herein, the term "non-transitory computer-readable media" includes all tangible, computer-readable media, including, without limitation, non-transitory computer storage devices, including, without limitation, volatile and nonvolatile media, and removable and non-removable media such as a firmware, physical and virtual storage, CD-ROMs, DVDs, and any other digital source such as a network or the Internet, as well as yet to be developed digital means, with the sole exception being a transitory, propagating signal.

Furthermore, as used herein, the term "real-time" refers to at least one of the time of occurrence of the associated events, the time of measurement and collection of predetermined data, the time to process the data, and the time of a system response to the events and the environment. In the embodiments described herein, these activities and events occur substantially instantaneously.

Embodiments of the present disclosure relate to a downhole dynamometer for a rod pumping unit. The downhole dynamometer described herein provides a plurality of sensors located within a shell that couples in-line with a sucker rod string of the rod pumping unit. The downhole dynamometer described herein is suitable for operation downhole in the production region of a well, preferably located in the sucker rod string just above the downhole pump of the rod pumping unit. In certain embodiments, the downhole dynamometer is located within several sections of sucker rod from the downhole pump, or, alternatively, where the sucker rod diameter transitions, e.g., from ¾ inch to ⅞ inch. The downhole dynamometer described herein enables downhole measurements of acceleration, displacement, and load of the sucker rod string, and temperature and pressure of the well. Such measurements enable computation of a downhole dynamometer card, or pump card, based on actual downhole measurements, rather than conventional computations based on surface measurements of sucker rod load and displacement. Further, the downhole dynamometer described herein is operable under battery power and includes non-transitory memory for storing downhole data, such as the downhole measurements of acceleration, displacement, load, temperature, and pressure. Stored measurements or downhole dynamometer cards are retrieved from the non-transitory memory when the downhole dynamometer is removed from the well after some duration of operation. The downhole dynamometer card is provided, at the surface, to a pump controller of the rod pumping unit for the purpose of calibrating the conventional computation of dynamometer cards based on surface measurements. In certain embodiments, the downhole dynamometer described herein may include a communication interface that enables transmission of stored measurements or downhole dynamometer cards from the downhole dynamometer while located downhole in the production region of the well. Such transmissions are received directly by the pump controller at the surface, or are relayed to the pump controller by one or more additional communication devices.

FIG. 1 is a diagram of an exemplary beam-type rod pumping unit, beam pumping unit 100 for use at a wellhead 102 of a well that extends beneath the surface for the purpose of producing gas and fluid from a well. Wellhead 102 includes an upper portion of a casing 104 and tubing 106. Casing 104 and tubing 106 extend into the well to facilitate a downhole pump that is actuated by a rod 108 to produce the gas and fluid.

Beam pumping unit 100 includes a surface support unit 110 that suspends rod 108 in the well. Surface support unit 110 includes a walking beam 112 pivotally coupled to a Samson post 114 by a pin 116. Rod 108 includes polished rod 118 that extends into casing 104 and tubing 106 through wellhead 102. Rod 108 also includes a cable 120 that flexibly couples rod 108 to walking beam 112 at a horsehead 122.

Beam pumping unit 100 is driven by a motor 124 through a gear box 126. Together, motor 124 and gear box 126 form a drive system 128 that, in certain embodiments, may include one or more belts, cranks, or other components. Through gear box 126, motor 124 turns a crank 130 having a crank arm 132. Crank arm 132 is coupled to walking beam 112 at an end opposite horsehead 122 by a pitman arm 134. Pitman arm 134 pivotably couples to crank arm 132 by a pin 136, and further pivotably couples to walking beam 112 by a pin 138. Pitman arm 134 is configured to translate angular motion of crank arm 132 into linear motion of walking beam 112. The linear motion of walking beam 112 provides the reciprocal motion of rod 108 for operating the downhole pump.

On an upstroke of beam pumping unit 100, the weight of rod 108, which is suspended from walking beam 112, is transferred to crank 130 and drive system 128. Crank arm 132 includes a counterweight 140 that is configured to reduce the load on drive system 128 during an upstroke.

Figure 2:
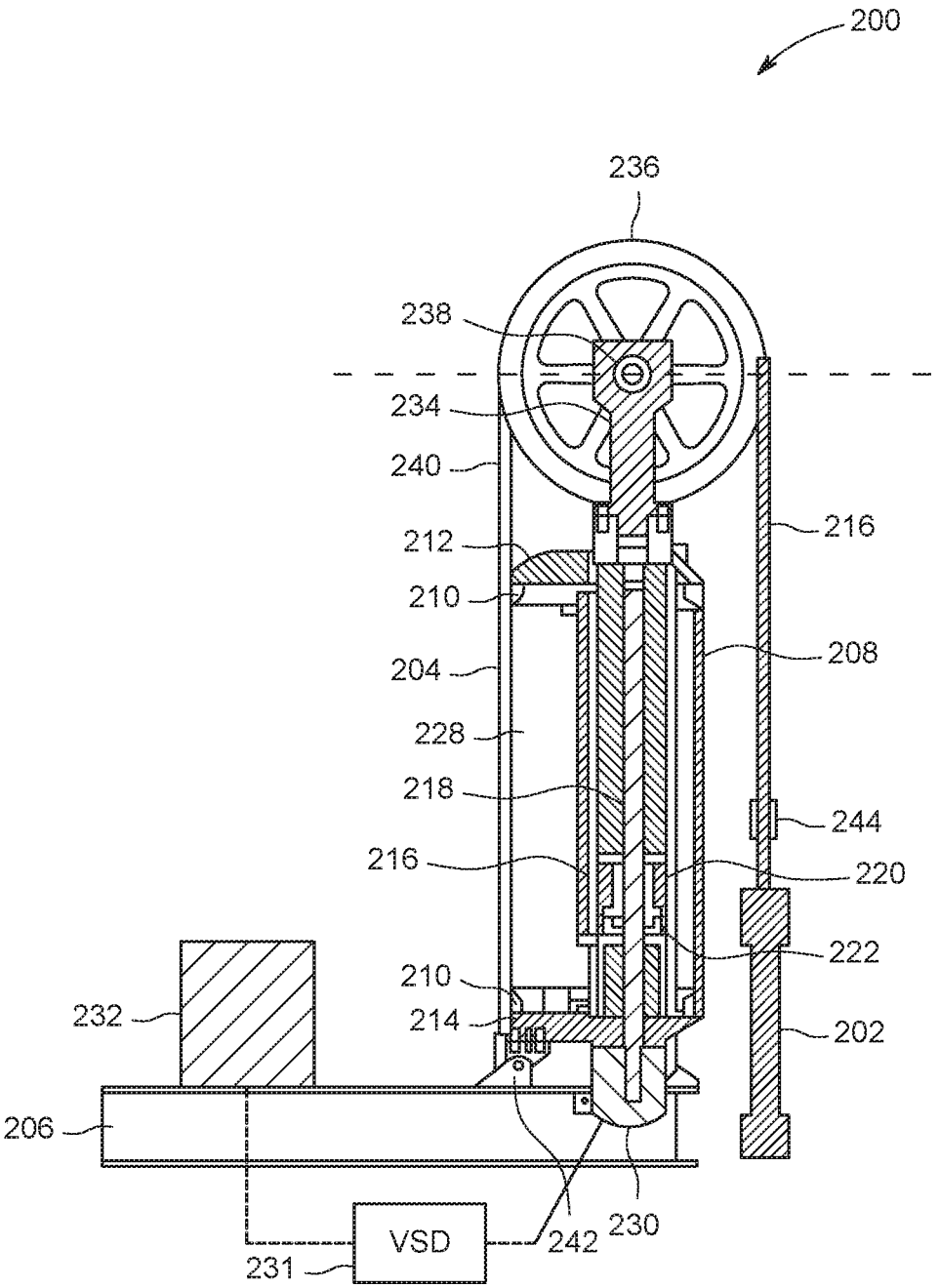
FIG. 2 is a cross-sectional view of an exemplary rod pumping unit in a fully retracted position.
Figure 3:
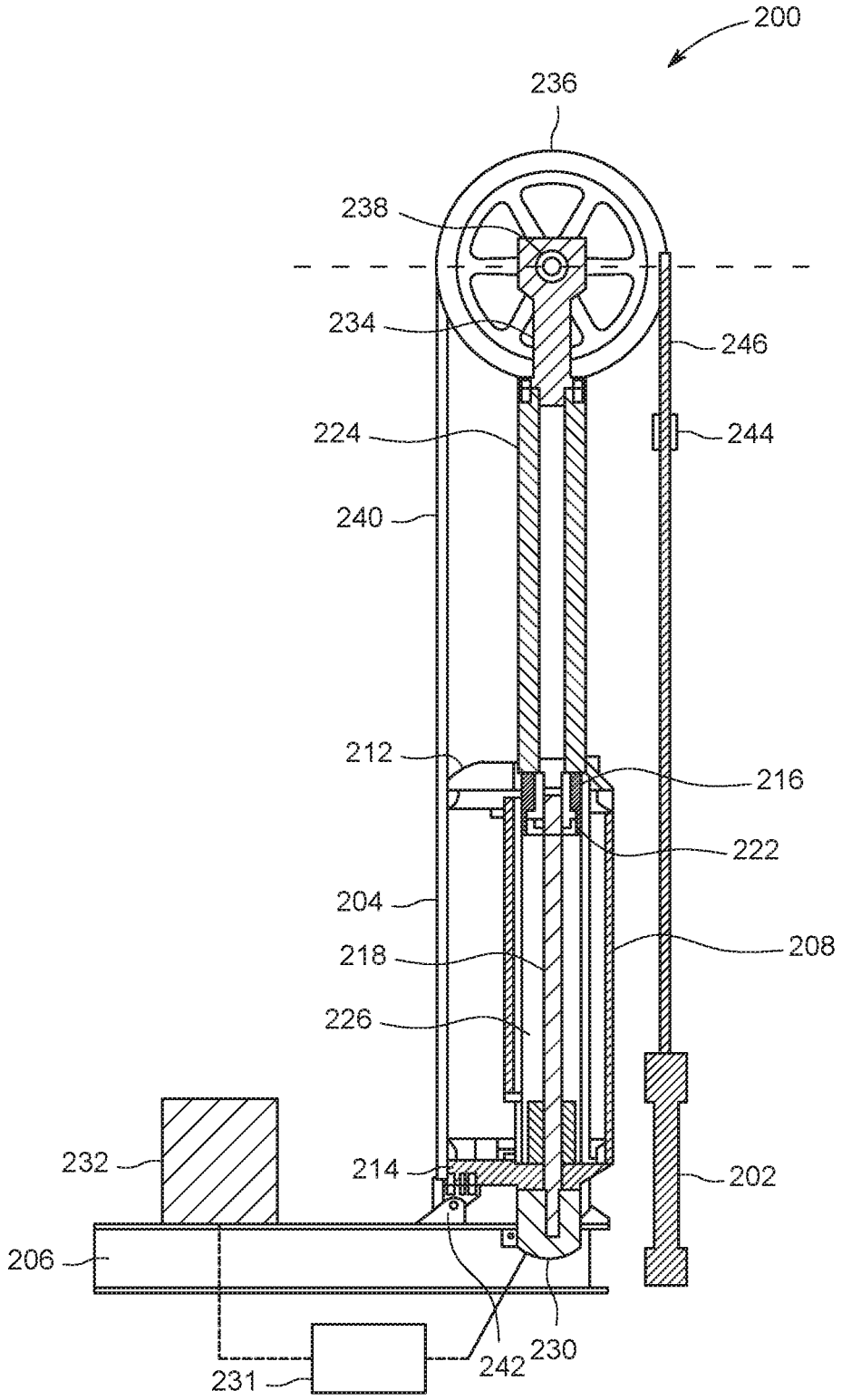
FIG. 3 is a cross-sectional view of the rod pumping unit shown in FIG. 2 in a fully extended position.

FIGS. 2 and 3 are cross-sectional views of an exemplary rod pumping unit 200 in fully retracted (1) and fully extended (2) positions, respectively. In the exemplary embodiment, rod pumping unit 200 (also known as a linear pumping unit) is a vertically oriented rod pumping unit having a linear motion vertical vector situated adjacent to a wellhead 202. Rod pumping unit 200 is configured to transfer vertical linear motion into a subterranean well (not shown) through a sucker rod string (not shown) for inducing the flow of a fluid. Rod pumping unit 200 includes a pressure vessel 204 coupled to a mounting base structure 206. In some embodiments, mounting base structure 206 is anchored to a stable foundation situated adjacent to the fluid-producing subterranean well. Pressure vessel 204 may be composed of a cylindrical or other appropriately shaped shell body 208 constructed of formed plate and cast or machined end flanges 210. Attached to the end flanges 210 are upper and lower pressure heads 212 and 214, respectively.

Penetrating upper and lower pressure heads 212 and 214, respectively, is a linear actuator assembly 216. This linear actuator assembly 216 includes a vertically oriented threaded screw 218 (also known as a roller screw), a planetary roller nut 220 (also known as a roller screw nut assembly), a forcer ram 222 in a forcer ram tube 224, and a guide tube 226.

Roller screw 218 is mounted to an interior surface 228 of lower pressure head 214 and extends up to upper pressure head 212. The shaft extension of roller screw 218 continues below lower pressure head 214 to connect with a compression coupling (not shown) of a motor 230. Motor 230 is coupled to a variable speed drive (VSD) 231 configured such that the motor's 230 rotating speed may be adjusted continuously. VSD 231 also reverses the motor's 230 direction of rotation so that its range of torque and speed may be effectively doubled. Roller screw 218 is operated in the clockwise direction for the upstroke and the counterclockwise direction for the downstroke. Motor 230 is in communication with a rod pumping unit controller 232. In the exemplary embodiment, rod pumping unit controller 232 transmits commands to motor 230 and VSD 231 to control the speed, direction, and torque of roller screw 218.

Within pressure vessel 204, the threaded portion of roller screw 218 is interfaced with planetary roller screw nut assembly 220. Roller screw nut assembly 220 is fixedly attached to the lower segment of forcer ram 222 such that as roller screw 218 rotates in the clockwise direction, forcer ram 222 moves upward. Upon counterclockwise rotation of roller screw 218, forcer ram 222 moves downward. This is shown generally in FIGS. 2 and 3. Guide tube 226 is situated coaxially surrounding forcer ram tube 224 and statically mounted to lower pressure head 214. Guide tube 226 extends upward through shell body 208 to slide into upper pressure head 212.

An upper ram 234 and a wireline drum assembly 236 and fixedly coupled and sealed to the upper end of forcer ram 222. Wireline drum assembly 236 includes an axle 238 that passes laterally through the top section of the upper ram 234. A wireline 240 passes over wireline drum assembly 236 resting in grooves machined into the outside diameter of wireline drum assembly 236. Wireline 240 is coupled to anchors 242 on the mounting base structure 206 at the side of pressure vessel 204 opposite of wellhead 202. At the wellhead side of pressure vessel 204, wireline 240 is coupled to a carrier bar 244 which is in turn coupled to a polished rod 246 extending from wellhead 202.

Rod pumping unit 200 transmits linear force and motion through planetary roller screw nut assembly 220. Motor 230 is coupled to the rotating element of planetary roller screw nut assembly 220. By rotation in either the clockwise or counterclockwise direction, motor 230 may affect translatory movement of planetary roller nut 220 (and by connection, of forcer ram 222) along the length of roller screw 218.

Figure 4:
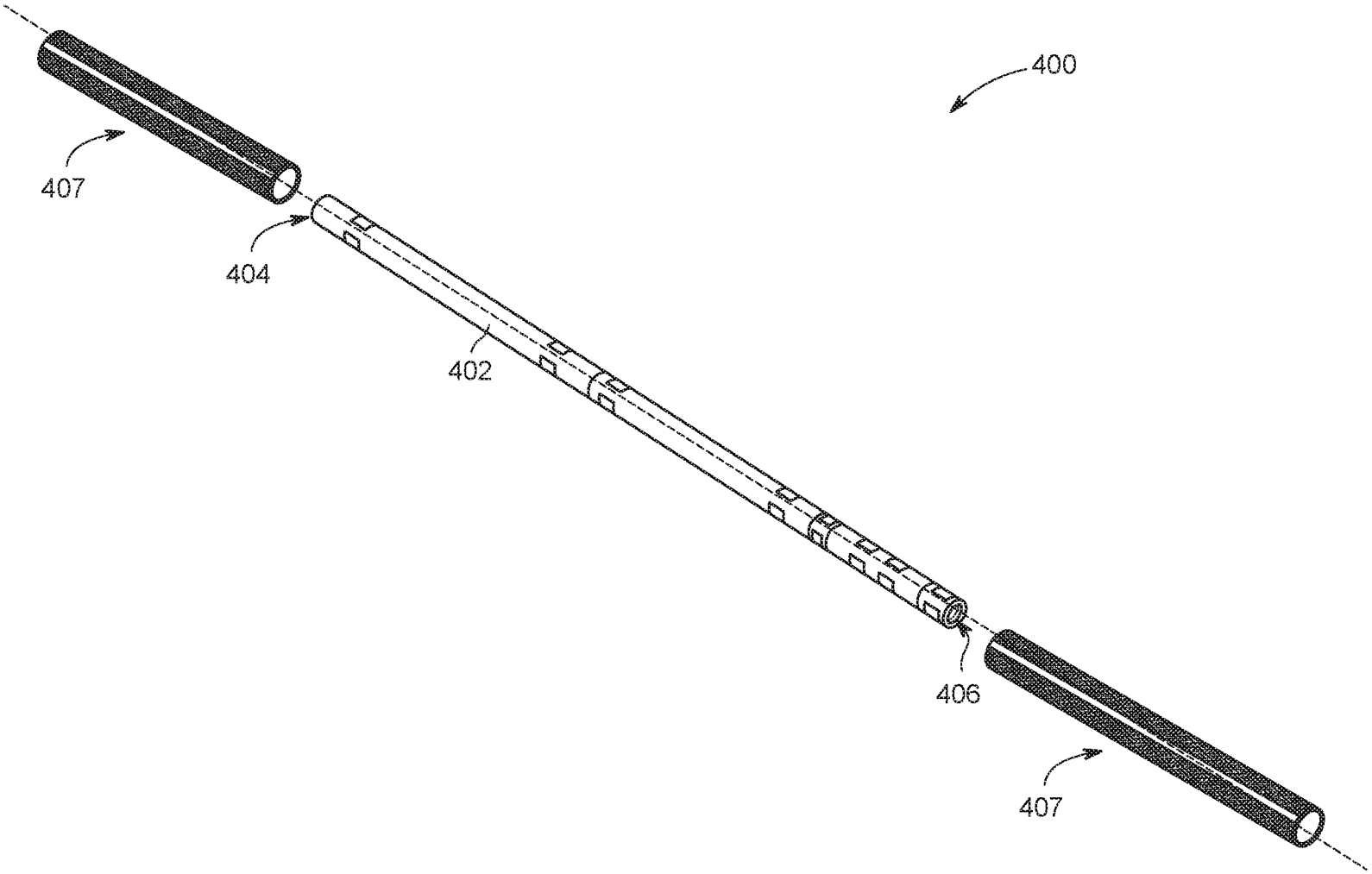
FIG. 4 is a perspective diagram of an exemplary downhole dynamometer for use in the rod pumping units shown in FIGS. 1-3.

FIG. 4 is a perspective diagram of an exemplary downhole dynamometer 400 for use in rod pumping units 100 and 200 (shown in FIGS. 1-3). Downhole dynamometer 400 includes a shell 402. Shell 402 is a cylindrical body having a first end 404 and a second end 406, opposite first end 404. First end 404 and second end 406 of downhole dynamometer 400 are configured to be respectively coupled to first and second adjacent sections of a sucker rod string 407 and disposed downhole in the well. Downhole dynamometer 400 is configured to be placed downhole in the production region of the well, near an end of sucker rod string 407 opposite the wellhead, e.g., wellhead 102 or wellhead 202 (shown in FIGS. 1-3). Preferably, downhole dynamometer 400 is coupled in-line to sucker rod string 407 within 150 feet, or approximately five sections of sucker rod, of a downhole pump (not shown) of rod pumping unit 100 or 200. In alternative embodiments, downhole dynamometer 400 is placed downhole in the well near enough to the downhole pump to measure and approximate downhole conditions, e.g., temperature, pressure, displacement, and load, at the downhole pump in the production region. In one embodiment, downhole dynamometer 400 is coupled, at second end 406, to a lower section of sucker rod to which the downhole pump is coupled. In another embodiment, downhole dynamometer 400 is coupled to sucker rod string 407 such that two sections of sucker rod are fixed between the downhole pump and downhole dynamometer 400. In yet another embodiment, downhole dynamometer 400 is coupled in-line with sucker rod string 407 where the sucker rod diameter transitions from ¾ inch to ⅞ inch. Downhole dynamometer 400 is coupled, at first end 404, to an upper section of sucker rod string 407. The upper section of sucker rod string 407, coupled to first end 404, is herein referred to as a first section of sucker rod string 407; and the lower section of sucker rod string 407, coupled to second end 406, is herein referred to as a second section of sucker rod string 407.

The shape, or cross-sectional profile, of shell 402 is cylindrical in the embodiment of FIG. 4. In alternative embodiments, shell 402 may be any other suitable shape to be coupled in-line with sucker rod string 407 and placed downhole within the well tubing, e.g., tubing 106. Notably, shell 402, when placed downhole, should not inhibit fluid flow within the tubing between an inner tubing wall and sucker rod string 407.

Figure 5:
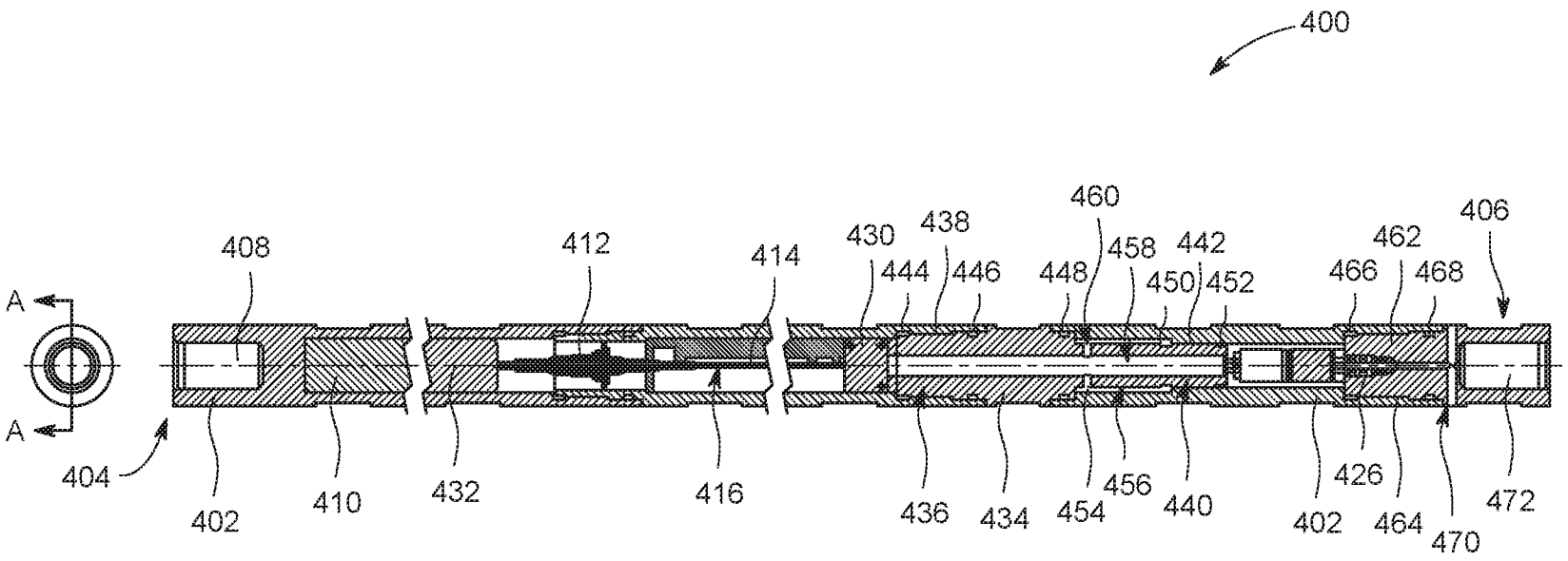
FIG. 5 is a schematic diagram of the downhole dynamometer shown in FIG. 4.
Figure 6:
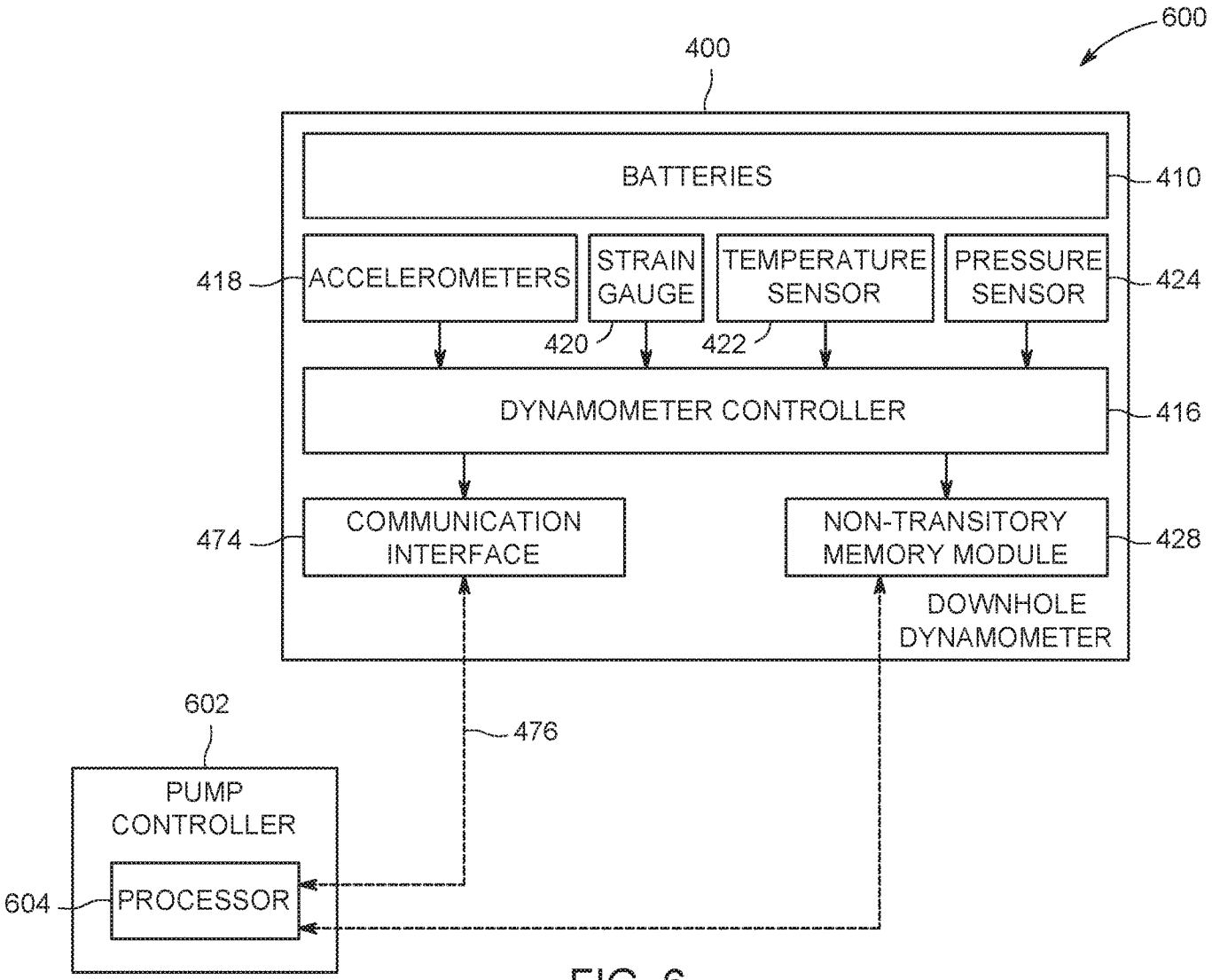
FIG. 6 is a block diagram of the downhole dynamometer shown in FIGS. 4 and 5.

FIG. 5 is a schematic diagram of downhole dynamometer 400 (shown in FIG. 4). More specifically, FIG. 5 shows a cross-sectional view A-A. FIG. 6 is a block diagram of downhole dynamometer 400. Referring to FIGS. 4, 5, and 6, downhole dynamometer 400 includes, at first end 404, a first rod coupling 408 configured to be coupled to the first section, or the upper section, of sucker rod string 407. Downhole dynamometer 400 includes one or more batteries 410 for powering various components of downhole dynamometer 400. Batteries 410 are configured to withstand high temperatures and pressures that develop downhole in the production region of the well. In certain embodiments, components, including batteries 410, can withstand temperatures up to 200 degrees Celsius and pressures up to 15,000 pounds per square inch (PSI). Further, batteries 410 are configured to provide power for operating downhole dynamometer 400 over a duration of operation. The duration of operation may be relatively long and is generally limited at least by the capacity of batteries 410. In one embodiment, batteries 410 provide power for up to seven months of operation downhole. The duration of operation may vary per embodiment, but is advantageously long to avoid frequent construction and deconstruction of sucker rod string 407, which increases time and cost of operation. For example, increasing the number of batteries 410 may provide for a longer duration of operation or greater power output, or a combination of both.

Power is supplied from batteries 410 through a power connector 412 to a main circuit board 414 on which a dynamometer controller 416 is located. Main circuit board 414 regulates power supplied from batteries 410 and carries signals between dynamometer controller 416 and a plurality of sensors, including accelerometers 418, a strain gauge 420, and a temperature sensor 422, and a pressure sensor 424. In certain embodiments, temperature sensor 422 and pressure sensor 424 are combined into a pressure/temperature transducer 426 (shown in FIG. 5). In alternative embodiments, temperature sensor 422 and pressure sensor 424 may be replaced by any other suitable sensor or system for measuring temperature and pressure. Further, main circuit board 414 includes a non-transitory memory module 428 configured to store measurements from the plurality of sensors 418, 420, 422, and 424.

Main circuit board 414 includes at least one accelerometer 418 configured to measure accelerations on two or more axes. Downhole dynamometer 400 includes a secondary circuit board 430 oriented orthogonal to main circuit board 414, i.e., secondary circuit board 430 is rotated approximately 90 degrees about a central axis 432 of downhole dynamometer 400 with respect to main circuit board 414. Secondary circuit board 430 includes at least one accelerometer 418 also configured to measure accelerations on two or more axes. Given multiple accelerometers 418 mounted on main circuit board 414 and secondary circuit board 430, respectively, dynamometer controller 416 is enabled to measure accelerations on three axes and improve precision of measurements of acceleration of sucker rod string 407. Further, accelerometers 418 enable measurement of sucker rod string displacement and a slope of the wellbore.

In alternative embodiments, downhole dynamometer 400 may include additional sensors for measuring sucker rod string displacement, such as, for example, and without limitation, optical sensors, LASER sensors, and induction coil sensors.

Downhole dynamometer 400 includes a solid bar section, or solid bar 434, to which a load on sucker rod string 407 is transferred for the purpose of measurement by strain gauge 420. Solid bar 434 and shell 402 are coupled at a first end 436 of solid bar 434, joined by threads 438. Likewise, solid bar 434 and shell 402 are coupled at a second end 440 of solid bar 434, joined by threads 442. The interior of shell 402 is sealed from liquids and gasses in the well by gaskets or O-rings (not shown) situated in annular voids 444 and 446 at first end 436, and annular voids 448, 450, and 452 at second end 440. Another annular void 454 defined by solid bar 434 and shell 402 enables placement of strain gauge 420 onto a load-bearing surface 456 of solid bar 434, enabling measurement of the downhole load on sucker rod string 407.

In alternative embodiments, downhole dynamometer 400 may include alternative or complementary sensors for measuring load, including, for example, and without limitation, a piezoelectric sensor. In further alternative embodiments, downhole dynamometer 400 includes multiple sensors for measuring load, such as, for example, multiple strain gauges. In such embodiments, the multiple sensors may be oriented orthogonal with respect to each other to enable load measurements in directions other than axial to detect, for example, bending and rotational torque.

Solid bar 434 defines a central cavity 458 extending axially along its length. Solid bar 434 includes openings 460 joining central cavity 458 and annular void 454. Openings 460 enable passage of wiring (not shown) into central cavity 458 where it is routed toward first end 436 and terminates at main circuit board 414.

Downhole dynamometer 400 includes a mounting section 462 into which pressure/temperature transducer 426 is fitted. Central cavity 458 enables routing of additional wiring (not shown) to couple pressure/temperature transducer 426 to main circuit board 414. Mounting section 462 is coupled to shell 402, joined by threads 464. The interior of shell 402 is again sealed from liquids and gasses in the well by gaskets or O-rings (not shown) situated in annular voids 466 and 468. Mounting section 462 further includes openings 470 enabling fluid communication between pressure/temperature transducer 426 and fluids and gasses in the well, enabling downhole measurement of temperature and pressure. Mounting section 462 further includes a second rod coupling 472 configured to couple downhole dynamometer 400 to a second section, or lower section, of sucker rod string 407 at second end 406.

In certain embodiments, downhole dynamometer 400 includes a communication interface 474 integrated into main circuit board 414, secondary circuit board 430, or an independent circuit board (not shown). In such an embodiment, communication interface 474 is configured to establish a communication channel 476 between downhole dynamometer 400 and a pump controller 602. More specifically, communication channel 476 enables communication between communication interface 474 and a processor 604 of pump controller 602. Pump controller 602 is located at the surface near wellhead 102 or 202 (shown in FIGS. 1-3). Communication channel 476 is any suitable communications channel for communicating from the production region of the well, at an end of sucker rod string 407 opposite wellhead 102 or 202. Communication channel 476 may include a radio frequency channel, an acoustic channel, an optical fiber channel, a serial channel, a parallel channel, a digital channel, an analog channel, or any other suitable wired or wireless communication medium.

Communication interface 474 is configured to transmit downhole data, such as downhole measurements from the plurality of sensors, 418, 420, 422, 424, and 426, over communication channel 476 to processor 604.

Similarly, non-transitory memory module 428, mounted on main circuit board 414, is configured to be coupled to processor 604 of pump controller 602 when downhole dynamometer is removed from the well. Non-transitory memory module 428 may, in certain embodiments, be removable from main circuit board 414 and insertable into pump controller 602. In alternative embodiments, main circuit board 414 and non-transitory memory module 428 are coupled to pump controller 602 over another communication channel, such as, for example, a universal serial bus (USB) connection. Connection of non-transitory memory module 428 to processor 604 enables communication of downhole data stored on non-transitory memory module 428 to pump controller 602.

Figure 7:
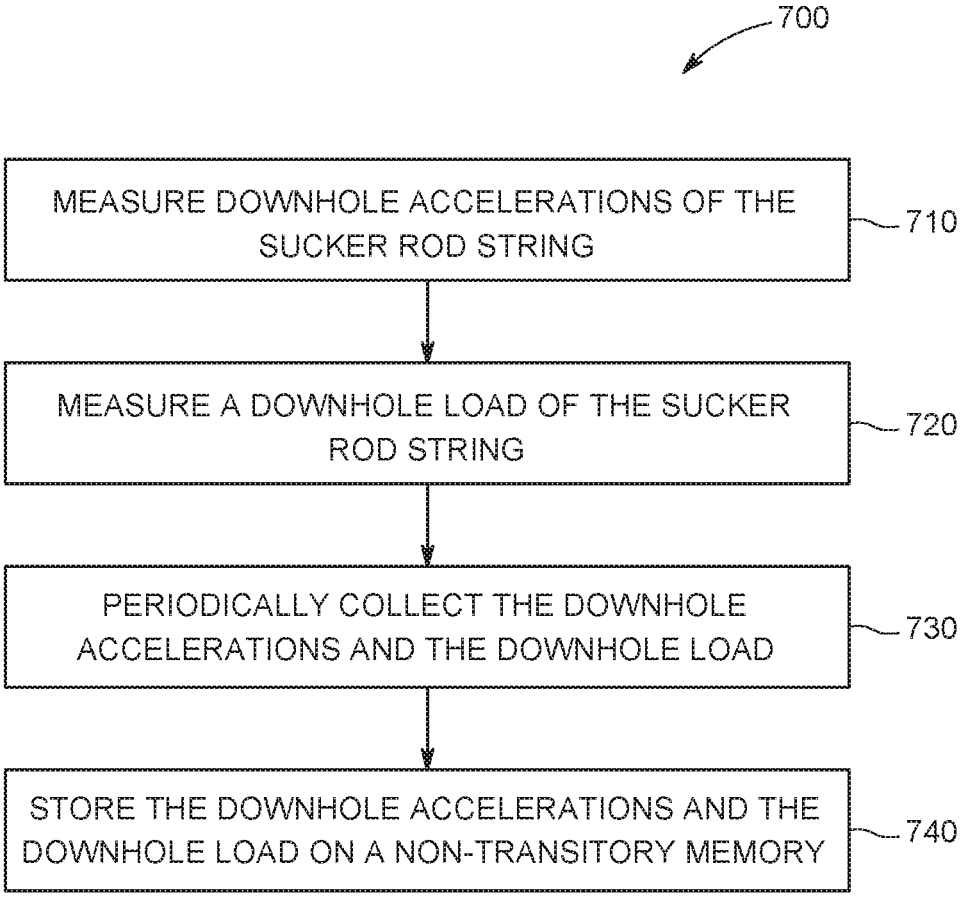
FIG. 7 is a flow diagram of an exemplary method of operating a downhole dynamometer.

FIG. 7 is a flow diagram of an exemplary method 700 of operating downhole dynamometer 400 (shown in FIGS. 4-6) disposed in a well opposite a wellhead thereof, such as, for example, wellhead 102 or 202 of rod pumping unit 100 or 200, respectively (shown in FIGS. 1-3). Downhole dynamometer 400 is coupled in-line with sucker rod string 407.

During operation of rod pumping unit 100 or 200, downhole dynamometer 400 measures 710 downhole accelerations of sucker rod string 407 using accelerometers 418. Measurements of downhole acceleration enable computation, by dynamometer controller 416 or processor 604, of sucker rod displacement and wellbore slope. Downhole dynamometer 400 also measures 720 a downhole load on sucker rod string 407 using strain gauge 420.

Measurements of downhole acceleration of sucker rod string 407 and downhole load on sucker rod string 407 vary with temperature and pressure at which accelerometers 418 and strain gauge 420 operate. Notably, downhole dynamometer 400, being suitable for operation for long periods of time downhole in the production region of the well, is exposed to extreme temperatures, e.g., up to 200 degrees Celsius, and pressures, e.g., up to 15,000 PSI. In certain embodiments, method 700 further includes measuring a downhole temperature of the well using a temperature sensor 422 and a downhole pressure of the well using a pressure sensor 424. Alternatively, downhole dynamometer may utilize combined pressure/temperature transducer 426 for measuring downhole temperature and pressure.

Measured downhole accelerations and downhole loads are periodically collected 730 by dynamometer controller 416, along with downhole temperatures and pressure in certain embodiments. Measurements may be collected at any desired rate. For example, in one embodiment, dynamometer controller 416 collects 730 measurements once every 15 to 20 minutes. Operators of downhole dynamometer 400 may increase or decrease the collection frequency based on their own requirements. For example, measurements may be collected 730 once every 24 hours. Dynamometer controller 416 stores 740 the downhole data in non-transitory memory module 428.

In certain embodiments, method 700 includes transmitting the downhole data stored in non-transitory memory module 428 using communication interface 474 and communication channel 476 to pump controller 602 located at the surface near wellhead 102 or 202.

In certain embodiments, method 700 includes gaining access to the measurements stored in non-transitory memory module 428 and computing a downhole dynamometer card based on the accelerations measured by accelerometers 418 and the downhole load measured by strain gauge 420. Computation of the downhole dynamometer card may be carried out on dynamometer controller 416 or processor 604 of pump controller 602.

In certain embodiments, method 700 includes calibrating measurements of the downhole accelerations and the downhole load based on the downhole temperature and the downhole pressure measured by temperature sensor 422 and pressure sensor 424, or by pressure/temperature transducer 426.

In certain embodiments, method 700 includes calibrating pump controller 602 based on the downhole dynamometer card. Such calibration improves accuracy of traditional surface dynamometer card computations that model sucker rod string 407.

In certain embodiments, method 700 includes booting dynamometer controller 416 and non-transitory memory module 428 in a normal operating mode, and subsequently configuring non-transitory memory module 428 to operate in a low power mode to conserve power in batteries 410.

The above described downhole dynamometer provides a plurality of sensors located within a shell that couples in-line with a sucker rod string of the rod pumping unit. The downhole dynamometer described herein is suitable for operation downhole in the production region of a well, preferably located in the sucker rod string just above the downhole pump of the rod pumping unit. In certain embodiments, the downhole dynamometer is located within several sections of sucker rod from the downhole pump, or, alternatively, where the sucker rod diameter transitions, e.g., from ¾ inch to ⅞ inch. The downhole dynamometer described herein enables downhole measurements of acceleration, displacement, and load of the sucker rod string, and temperature and pressure of the well. Such measurements enable computation of a downhole dynamometer card, or pump card, based on actual downhole measurements, rather than conventional computations based on surface measurements of sucker rod load and displacement. Further, the downhole dynamometer described herein is operable under battery power and includes non-transitory memory for storing downhole data, such as the downhole measurements of acceleration, displacement, load, temperature, and pressure. Stored measurements or downhole dynamometer cards are retrieved from the non-transitory memory when the downhole dynamometer is removed from the well after some duration of operation. The downhole dynamometer card is provided, at the surface, to a pump controller of the rod pumping unit for the purpose of calibrating the conventional computation of dynamometer cards based on surface measurements. In certain embodiments, the downhole dynamometer described herein may include a communication interface that enables transmission of stored measurements or downhole dynamometer cards from the downhole dynamometer while located downhole in the production region of the well. Such transmissions are received directly by the pump controller at the surface, or are relayed to the pump controller by one or more additional communication devices.

An exemplary technical effect of the methods, systems, and apparatus described herein includes at least one of: (a) placing a downhole dynamometer in-line with the sucker rod string; (b) operating a downhole dynamometer in a production region of the well; (c) collecting downhole measurements of downhole acceleration, load, temperature, and pressure; (d) calibrating downhole measurements of downhole acceleration and load based on downhole measurements of temperature and pressure; (e) calibrating, using the downhole data, computations of dynamometer cards based on surface measurements; (f) improving performance of sucker rod string models used by the pump controller in computing dynamometer cards based on surface measurements; (g) improving accuracy of dynamometer cards; and (h) improving diagnostic capabilities that rely on dynamometer cards.

Exemplary embodiments of methods, systems, and apparatus for downhole dynamometers are not limited to the specific embodiments described herein, but rather, components of systems and/or steps of the methods may be utilized independently and separately from other components and/or steps described herein. For example, the methods may also be used in combination with other non-conventional downhole dynamometers, and are not limited to practice with only the systems and methods as described herein. Rather, the exemplary embodiment can be implemented and utilized in connection with many other applications, equipment, and systems that may benefit from reduced cost, reduced complexity, commercial availability, improved reliability at high temperatures, and increased memory capacity.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A downhole dynamometer for a rod pumping unit, comprising:

a shell configured to be coupled to a sucker rod string of the rod pumping unit and disposed in a well opposite a wellhead of the well;

a plurality of sensors located within said shell and configured to:

measure downhole accelerations of the sucker rod string; and measure a downhole load on the sucker rod string;

measure a downhole temperature;

measure a downhole pressure;

a non-transitory memory located within said shell; and a dynamometer controller located within said shell and coupled to said plurality of sensors and said non-transitory memory, said dynamometer controller configured to periodically collect measurements from said plurality of sensors and store the measurements in said non-transitory memory.

2. The downhole dynamometer of claim 1 further comprising at least one battery.

3. The downhole dynamometer of claim 1, wherein said shell comprises:

a first end configured to be coupled to a first section of the sucker rod string; and a second end, opposite said first end, configured to be coupled to a second section of the sucker rod string, the second section coupled to a downhole pump of the rod pumping unit.

4. The downhole dynamometer of claim 1, wherein said plurality of sensors comprises an accelerometer configured to:

measure accelerations along three axes;

measure a displacement of the sucker rod string; and measure a slope of a wellbore of the well.

5. The downhole dynamometer of claim 1, wherein said plurality of sensors comprises a strain gauge configured to measure the downhole load.

6. The downhole dynamometer of claim 1, wherein said plurality of sensors comprises a combination pressure and temperature sensor configured to measure a downhole temperature and a downhole pressure of a fluid in the well.

7. The downhole dynamometer of claim 1 further comprising a communication interface located within said shell and coupled to said dynamometer controller, said communication interface configured to transmit the measurements collected from said plurality of sensors to a pump controller at the wellhead.

8. A rod pumping unit comprising:

a sucker rod string;

a downhole dynamometer configured to be coupled to the sucker rod string and disposed in a well opposite a wellhead of the well, said downhole dynamometer comprising:

a plurality of sensors configured to measure downhole conditions of the well, wherein said plurality of sensors comprises a temperature sensor and a pressure sensor located within said shell, said temperature sensor and said pressure sensor configured to measure a downhole temperature and a downhole pressure, respectively;

a non-transitory memory; and a dynamometer controller coupled to said plurality of sensors and said non-transitory memory, said dynamometer controller configured to periodically collect measurements from said plurality of sensors and store the measurements in said non-transitory memory;

a pump controller comprising a processor configured to be coupled to said non-transitory memory, said processor further configured to:

gain access to the measurements in said non-transitory memory; and compute a downhole dynamometer card based on the measurements.

9. The rod pumping unit of claim 8, further comprising a communication channel facilitating communication between said pump controller and said dynamometer controller, said pump controller further configured to gain access to the measurements using said communication channel.

10. The rod pumping unit of claim 8, wherein said downhole dynamometer is further configured to operate at downhole temperatures up to 200 degrees Celsius.

11. The rod pumping unit of claim 8, wherein said downhole dynamometer is further configured to operate at downhole pressures up to 15,000 pounds per square inch (PSI).

12. The rod pumping unit of claim 8, wherein said sucker rod string comprises:

a first section extending from the wellhead to a production region of the well situated opposite the wellhead, said first section coupled to a first end of said downhole dynamometer disposed in the production region; and a second section disposed in the production region and coupled between said downhole dynamometer and a downhole pump of said rod pumping unit.

13. The rod pumping unit of claim 8 further comprising surface sensors coupled to said pump controller and configured to:

measure a surface load and a surface displacement of said sucker rod string; and compute a dynamometer card based on the downhole dynamometer card, the surface load, and the surface displacement.

14. A method of operating a downhole dynamometer disposed in a well opposite a wellhead thereof, and coupled to a sucker rod string of a rod pumping unit, said method comprising:

measuring downhole accelerations of the sucker rod string;

measuring a downhole load of the sucker rod string;

measuring a downhole temperature of the well;

measuring a downhole pressure of the well;

periodically collecting the downhole accelerations and the downhole load; and storing the downhole accelerations and the downhole load on a non-transitory memory.

15. The method of claim 14 further comprising transmitting the downhole accelerations and the downhole load to a pump controller of the rod pumping unit.

16. The method of claim 14 further comprising:

computing a downhole dynamometer card based on the downhole accelerations, the downhole load, the downhole temperature, and the downhole pressure.

17. The method of claim 16 further comprising calibrating a pump controller for the rod pumping unit based on the downhole dynamometer card.

18. The method of claim 14 further comprising calibrating measurements of the downhole accelerations and the downhole load based on the downhole temperature and the downhole pressure.

19. The method of claim 14, wherein periodically collecting comprises measuring the downhole accelerations and the downhole load at a rate of once every fifteen minutes.

20. The method of claim 14 further comprising:

booting a dynamometer controller and a non-transitory memory module; and configuring the non-transitory memory module to operate in a low-power mode.

* * * * *